United States Patent [19]

Hayner

[11] 3,943,957

[45] Mar. 16, 1976

[54] FLOW CONTROL VALVE WITH INTERNAL RATE OF FLOW FEEDBACK

[75] Inventor: Paul F. Hayner, Gilford, N.H.

[73] Assignee: Sanders Associates, Inc., Nashua, N.H.

[22] Filed: Mar. 17, 1975

[21] Appl. No.: 558,754

[52] U.S. Cl. ..... 137/85; 137/625.64; 137/625.63

[51] Int. Cl.[2] ..... F15B 13/044

[58] Field of Search..... 137/625.64, 625.63, 625.62, 137/625.69, 85; 91/469

[56] References Cited

UNITED STATES PATENTS

| | | | |
|---|---|---|---|
| 3,874,269 | 4/1975 | Walters | 137/625.64 X |
| 3,899,002 | 8/1975 | Hayner | 137/625.62 |

*Primary Examiner*—Alan Cohan

*Attorney, Agent, or Firm*—Louis Etlinger; William L. Hunter

[57] ABSTRACT

A two-stage fluid flow control valve system employing feedback such that the rate of flow of fluid through the load connections follows an input signal very closely over a wide dynamic range. The system employs poppet valves as flow sensors in the return line. The rate of flow of fluid through these sensors is a non-linear function of the pressure thereacross such that the change in pressure drop resulting from a given displacement from a set flow rate is greater at low ranges of flow than at high ranges. The result is closer control at low rates of flow where such control is normally more difficult to achieve.

12 Claims, 4 Drawing Figures

FLOW CONTROL VALVE WITH INTERNAL RATE OF FLOW FEEDBACK

FIELD OF THE INVENTION

This invention relates to fluid flow control valves in which the rate of flow of fluid to a load is determined by an input signal and is substantially independent of variations in either system pressure or back pressure.

BACKGROUND

Flow control valves of many kinds have been known but as far as applicant is aware, all have been subject to one or more serious limitations. Some valves have exhibited poor accuracy. Some have exhibited acceptable accuracy over only a limited dynamic range. Some have failed to provide a positive definite neutral position at which there is truly zero flow for a zero input signal. Some valves have required one or even two pressure regulated power supplies. Some valves have required external feedback connections.

It is an object of the present invention to provide an improved flow control valve in which the rate of output fluid flow follows an input signal closely over a wide dynamic range.

SUMMARY OF THE INVENTION

Briefly stated, the invention is based in part upon the discovery that a poppet valve makes an excellent flow sensor and, when interposed in a line in which fluid is flowing, exhibits a favorable relationship between the rate of flow and the pressure drop thereacross. A two stage four way valve incorporating the invention utilizes two such sensors, one in each of the fluid return paths between the second stage valve proper and the fluid return connection. The pressure drops across these sensors constitute feedback signals which are led to the first stage where they are, in effect, compared to the input signal so as to develop an error signal which controls the first stage valve which, of course, in turn controls the second stage valve.

DESCRIPTION OF PREFERRED EMBODIMENTS

For a clearer understanding of the invention reference may be made to the following detailed description and the accompanying drawings in which.

Figure 1:
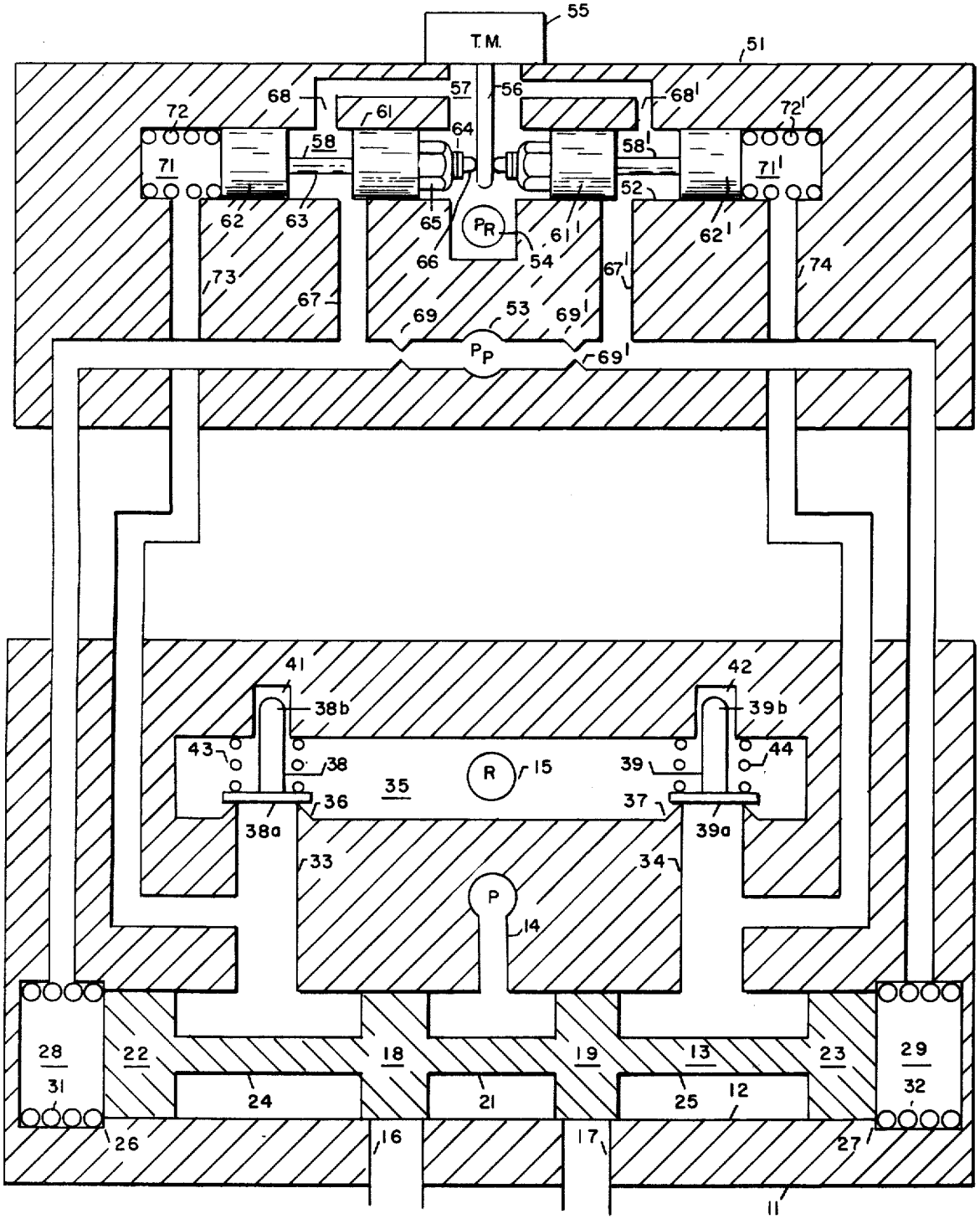
FIG. 1 is a schematic cross sectional diagram of a two stage closed center valve system incorporating the present invention.

Referring now to FIG. 1, the valve includes a main or second stage housing 11. The term housing is intended to include blocks, sleeves, end caps, manifolds, etc. and in general all of the stationary structure of the valve. The housing 11 is formed to define a hollow cylinder 12 in which is disposed a piston indicated generally by the reference character 13. The housing is also formed to define a fluid inlet connection 14 which communicates with the cylinder 12 in approximately the center of the valve. In operation, it is intended that the connection 14 be connected to a source of fluid under pressure. The housing 11 is also formed to define first and second fluid load connections 16 and 17 which communicate with the interior of the cylinder 12 at positions axially displaced to either side of the inlet connection 14.

The piston 13 includes first and second inboard lands 18 and 19 joined together by a reduced diameter portion 21. The lands 18 and 19, as well as the remaining lands to be referred to subsequently, are generally cylindrical in shape and make a hydraulic fit with the interior of the cylinder in which they are placed, that is, in the case of lands 18 and 19, with the cylinder 12. In the neutral position of the parts shown in FIG. 1, the lands 18 and 19 are approximately equally spaced on opposite sides of the inlet connection 14 and are of such size and are so positioned as to occlude the load connections 16 and 17 respectively with a small amount of overlap on each side. The piston 13 also includes two outboard lands 22 and 23 which are joined by reduced diameter portions 24 and 25 to the inboard lands 18 and 19 respectively. At each end, the hollow cylinder 12 extends beyond the lands 22 and 23 and has an increased diameter so as to form annular shoulders 26 and 27 respectively and so as to define end spaces 28 and 29. A spring 31 is prestressed and placed in the end space 28 so as to bear on the left against the housing 11 and on the right to bear partially against the shoulder 26 and partially against the land 22. A similar spring 32 is disposed in the end space 29 and bears in part against the shoulder 27 and in part against the land 23. These springs are quite weak compared to the hydraulic forces normally encountered and are used to insure the return of the piston 13 to the neutral position shown in the absence of hydraulic pressure and also for the additional purpose, as will be more fully explained, of assisting in establishing a predetermined dead space at which no fluid flows even though there be a small input signal.

The housing 11 is also formed to define first and second fluid return paths 33 and 34 which communicate with the interior of the cylinder 12 in the region of the reduced diameter portions 24 and 25 respectively, that is, to the sides of the lands 18 and 19 which are remote from the inlet connection 14. The housing 11 is also formed to define an internal chamber 35 with which both of the fluid return paths 33 and 34 may communicate. At the point where these paths join the chamber 35, the housing is formed to define valve seats 36 and 37 respectively. These valve seats cooperate with poppet valves 38 and 39 respectively. The valve 38 includes a plate-like portion 38*a* which cooperates with the seat 36 and also includes a stem portion 38*b* which extends into a recess 41 formed in the housing 11. The poppet valve 39 similarly includes a plate-like member 39*a* cooperating with the valve seat 37, and a stem portion 39*b* which extends into a recess 42 in the housing 11. Expansion springs 43 and 44 are disposed so as to bear against the plate-like members 38*a* and 39*a* respectively and urge them into engagement with their respective valve seats 36 and 37.

The valve system of FIG. 1 also includes a first stage which has a pilot housing 51 formed to define a pilot hollow cylinder 52, a pilot inlet connection 53 and a pilot return connection 54. It is contemplated that during the operation of the system the pilot inlet connection 53 will be connected to a source of fluid under pressure. This source may be the same source as is used for the second stage but since filtration requirements are usually different for the first and second stages the sources may be different. The pressures may be the same or different and there is no requirement that either or both be closely regulated as to pressure.

The first stage includes a torque motor 55 having an actuating arm 56. In operation, it is contemplated that the torque motor will receive an input signal and, in response thereto, deflect the actuating arm 56 to the left or right as viewed in FIG. 1. The torque motor 55 is of conventional construction and includes weak internal springs which urge the arm 56 towards the neutral position shown in the absence of an input signal. The housing 51 is also formed to define a central chamber 57 which communicates with the cylinder 52 in approximately the center thereof. The torque motor 55 is mounted on the housing 51 in such a way that the actuating arm extends through the chamber 57 and intersects the axis of the cylinder 52 in approximately the center thereof. The chamber 57 communicates with the pilot return connection 54.

Within the cylinder 52 are disposed two separate pilot pistons indicated generally by the reference characters 58 and 58' respectively. The piston 58 includes a first or inboard land 61 and a second or outboard land 62 connected thereto by a reduced diameter portion 63. The land 61 includes an adjusting screw 64 inserted in a central aperture in the face of the land towards the center of the assembly. The screw 64 includes a self locking nut 65 and a rounded tip 66 which, in the neutral position of the parts shown in FIG. 1, engages the actuating arm 56 of the torque motor 55. It will be understood that the piston 58' is of similar construction and need not be described in detail. Similar parts are denoted by corresponding, but primed, reference characters.

The housing 51 is also formed to define a first control conduit 67 which communicates with the interior of the cylinder 42 in the region of the left hand face of the land 61, as viewed in FIG. 1, so that, in the neutral position shown, there is a partially open variable orifice defined by the land 61, the housing 51, and the control conduit 67. The portion of the hollow cylinder 52 in the region between the lands 61 and 62 communicates, by means of a passageway 68, with the chamber 57 and the return connection 54. Similarly, the housing 51 is formed to define a second control conduit 67' which, with the land 61' and the housing 51 forms a second variable orifice which is also slightly open in the neutral position of the parts shown in the drawing. Also, the space between the lands 61' and 62' is connected to the chamber 57 by means of a passageway 68'. The control conduit 67 is connected through a fluid restrictor 69 to the pilot inlet connection 53 and similarly the control conduit 67' is connected through a restrictor 69' to the pilot inlet connection 53.

The cylinder 52 extends beyond the lands 62 and 62' to form end spaces 71 and 71' respectively. These end spaces are preferably of the same diameter as the remainder of the cylinder 52 and centering springs 72 and 72' are placed therein and bear directly against the lands 62 and 62'. These springs are preferably quite weak and are primarily for the purpose of returning the pistons to the neutral position in the absence of an input signal or should there be a failure of the supply of fluid under pressure. The end spaces 71 and 71' communicate with feedback passageways 73 and 74 respectively which in turn communicate with the fluid return paths 33 and 34 of the main stage at points upstream of the poppet valves 38 and 39. The conduits 67 and 67' extend to the main stage and communicate with the end spaces 28 and 29 respectively.

OPERATION

With the position of the parts shown in FIG. 1, everything is in its neutral position and there is no flow of fluid to either of the load connections 16 or 17. If there were no hysteresis in the torque motor, if there were no variations due to temperature changes, and if there were no friction, then the various centering springs would not be needed to provide a dead space and the poppet valves could be replaced by some sort of sensor which allows flow at all times and never makes a tight seal. However, conditions are never perfect and it has been found that various conditions such as a small amount of hysteresis in the torque motor and/or spurious signals do, in the absence of precautions, cause unwanted displacements of the parts and unwanted flow of fluid to the load. Accordingly, the construction previously described is preferred.

Let us assume now that there is a very small signal applied to the torque motor 55 which may be spurious or just a small signal. Let us assume that this signal is in such a direction as to tend to move the arm 56 and the piston 63 to the left. It might be thought at first glance that the space 71, the feedback passageway 73, the fluid return path 33 and the cylinder 12 would form a fluid lock so as to prevent the movement of the piston 63. However, it must be remembered that the piston 63 actually moves a very short distance and displaces a very small amount of fluid. It has been found that the inherent leakage is sufficient to prevent the problem of fluid lock from arising so that a very small signal applied to the torque motor will, in fact, displace the piston 63 to the left and the spring 72' will cause the piston 58' to follow. When so displaced, the orifice associated with the control conduit 67 is decreased while that associated with the control conduit 67' is increased thereby creating a differential pressure in these conduits which tends to move the main piston 13 to the right. If the input signal and the resulting differential pressure is very small, the centering springs 31 and 32 will prevent movement of the piston 13 until a threshold value of differential pressure is reached. Then the piston 13 will be shifted and, assuming that the fluid inlet connection 14 is connected to a source of fluid under pressure, fluid will tend to flow from the inlet connection 14 to the load connection 17 and back through the load connection 16 to the fluid return path 33. Since the poppet valve 38 is closed at this time, there is no place for the fluid to go. However, the increase in pressure is transmitted through the feedback passageway 73 to the end space 71 where it opposes the action of the input signal and urges the piston 63 to the right. This, in turn, reduces the differential control pressure and the system reaches an equilibrium position with no fluid flowing through the load conduits 16 and 17.

Let us assume that now a significant input signal is applied to the torque motor 55 again in a sense such as to urge the arm 56 to the left. As before, the piston 63 will move to the left and establish a differential control pressure in the control conduits 67 and 67' which will shift the piston 13 to the right. Now, when fluid flows through the load connection 16 to the fluid return path 33, the poppet valve 38 will open allowing the fluid to flow to the return connection 15. The pressure drop across the poppet valve 38 is transmitted through the feedback passageway 73 to the end space 71. This pressure is converted to a force against the face of the land 62 which is compared with the force exerted by the arm 56 of the torque motor 55. An equilibrium position is reached when these forces are equal and they will be equal when a differential pressure is established in the control conduits 67 and 67' which is just sufficient to overcome the force of the springs 31 and 32. The piston 13 will remain its then obtaining position and the flow of fluid through the load connections 16 and 17 will be that prescribed by the input signal within a very small limit of error.

Figure 2:
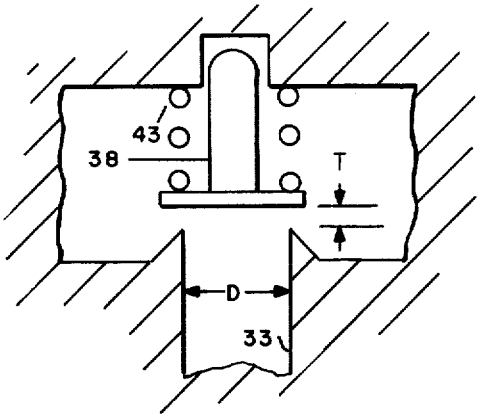
FIG. 2 is a fragmentary cross sectional diagram of one of the flow sensors and is useful in explaining the invention.

Referring now to FIG. 2, one of the poppet valves is shown in a slightly open position it might occupy when a significant amount of fluid is flowing to the load. As shown, the valve is raised a distance T above its valve seat; the diameter of the fluid return path 33 is assumed to be D and the pressure in this conduit is designated $P_{FB}$. The flow of fluid through an orifice may be expressed as:

$$Q = KA\sqrt{\Delta P} \qquad (1)$$

where $Q$ = rate of fluid flow,
$K$ = the orifice constant,
$A$ = the area of the orifice, and
$\Delta P$ = the pressure drop across the orifice For present purposes the pressure on the downstream side of the orifice can be considered zero since it is connected to the fluid return and therefore $\Delta P = P_{FB}$.

The area across which the fluid is flowing can be expressed as $$A = \pi DT \qquad (2)$$

Neglecting the pre-loading of the spring 43, the distance $T$ can be expressed as $$T = \frac{\frac{\pi D^2}{4} \times P_{FB}}{K_S} \qquad (3)$$

when $K_S$ is the spring constant. Accordingly, equation (1) can be rewritten as $$Q = \frac{K\pi D}{K_S} \frac{\pi D^2}{4} P_{FB}\sqrt{P_{FB}} \qquad (4)$$

or as $$Q = \frac{K}{K_S} \frac{\pi^2}{4} D^3 \times (P_{FB})^{3/2} \qquad (5)$$

Figure 3:
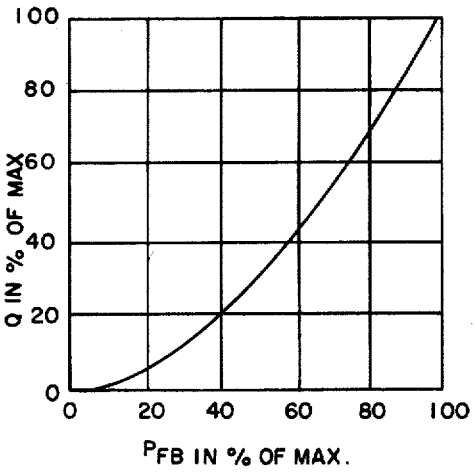
FIG. 3 is a graph useful in explaining the invention.

As previously explained, it is preferred that the spring 43 be slightly pre-loaded so that there is a threshold amount of feedback pressure required before there is any flow at all. Taking this into consideration, the relationship between feedback pressure and rate of flow is approximately as shown in FIG. 3 where both rate of flow and feedback pressure are shown in terms of percent of maximum.

The feedback signal applied to the first stage piston is a force which balances the force exerted by the arm 56. This force is substantially proportional to the input signal where the input signal is expressed as a current. Accordingly, a curve expressing the variation in rate of flow as a function of input signal has substantially the same form as shown in FIG. 3. As shown in this figure, the non-linearity is in such a direction that the curve is flatter for low values of both the rate of flow and input signal than it is for higher values. This means that a given departure from the set rate of flow (that is, the rate prescribed by the input signal) produces a larger absolute change in feedback pressure at low rates of flow than it does at high rates of flow. This in turn means that close control of the rate of flow is obtained at low ranges, especially below 10 percent of full flow, so that the dynamic range of the valve (the range of set flows for which satisfactory accuracy is obtained) is greatly extended.

Figure 4:
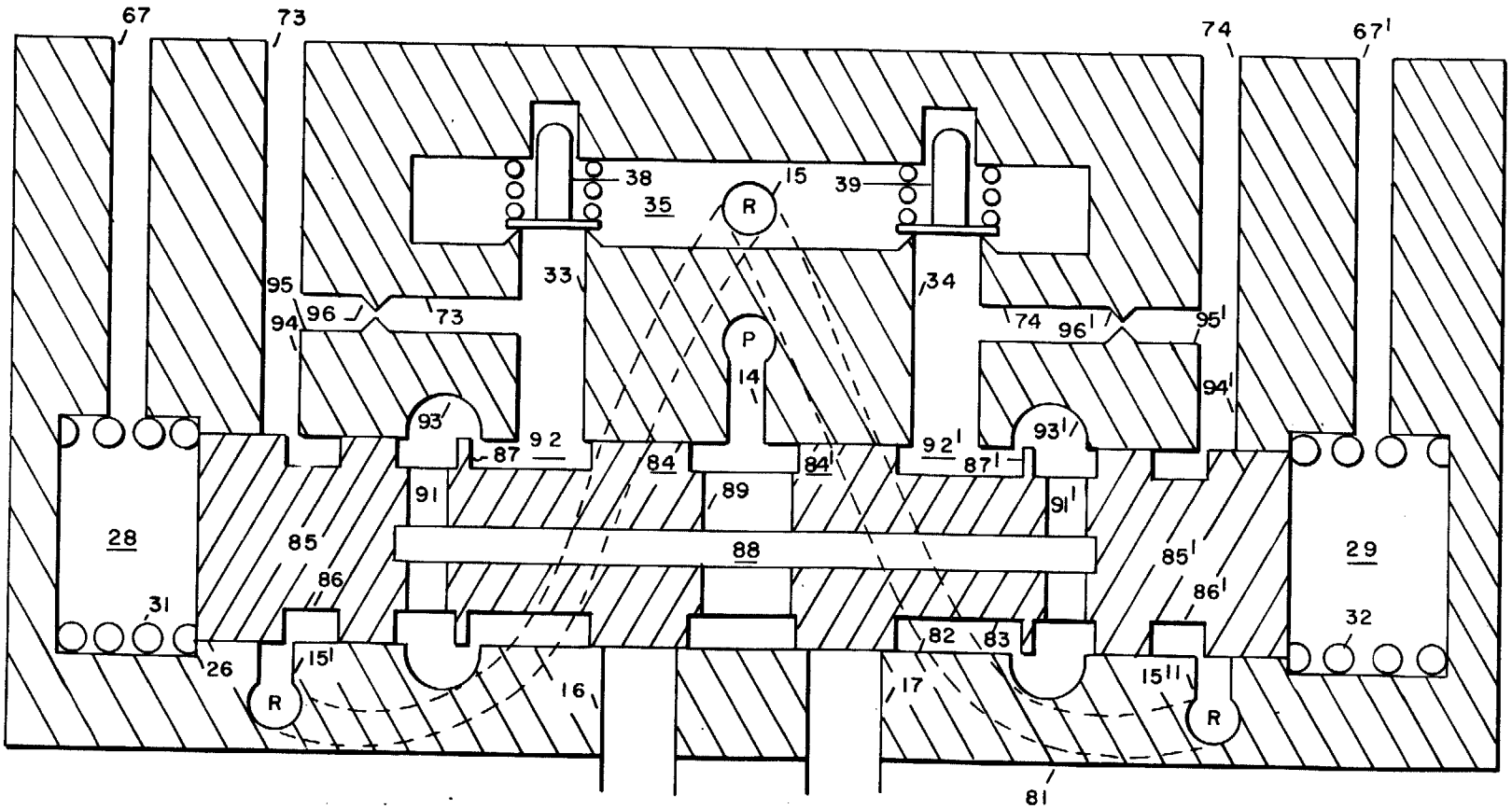
FIG. 4 is a schematic diagram of an open center valve incorporating the invention.

FIG. 4 illustrates how the invention may be applied to an open center valve. Such valves are constructed so that, in the neutral or "center" position with no fluid flowing to either load connection, there is a low friction hydraulic path extending from the inlet connection to the outlet connection. Such valves are particularly suitable for use with a constant flow power supply such as a fixed displacement pump. Under such circumstances, when no fluid is flowing to the load, the pump encounters very little back pressure and consequently draws very little power. The valve of FIG. 4 is similar in many respects to the valve of FIG. 1 and like parts have been denoted by the same reference characters. The entire first stage may be identical to that of FIG. 1 and accordingly has not been illustrated in FIG. 4.

The valve of FIG. 4 includes a housing 81 which is formed to define a hollow cylinder 82 in which is disposed a piston indicated generally by the reference character 83. The piston includes inboard lands 84 and 84' similar to the lands 18 and 19 of FIG. 1 and which, in the neutral position, shown, completely cover the load connections 16 and 17 with a small amount of overlap. The piston 83 also includes outboard lands 85 and 85' similar to the lands 22 and 23 of FIG. 1 except that they are formed with annular grooves 86 and 86' respectively. The piston 83 also includes fifth and sixth lands 87 and 87' the former of which is located between the lands 84 and 85 and the latter of which is located between the lands 84' and 85'. Each of these lands is quite narrow in the axial direction. The piston 83 is also formed to define an axial bore which extends from a point between the lands 85 and 87 to a point between the lands 85' and 87' and may even, as shown, extend as far as the lands 85 and 85' respectively. The piston 83 also includles a set of passageways comprising one or more radially extending apertures 89 at approximately the center thereof which provide communication between the axial bore 88 and the interior of the hollow cylinder 82 between the lands 84 and 84' in the region where the inlet connection 14 communicates with the cylinder 82. The cylinder 83 also includes second and third sets of passageways comprising radially extending apertures 91 and 91' the former of which interconnects the axial bore 88 with the hollow cylinder 82 between the lands 85 and 87 and the latter of which interconnects the axial bore 88 with the cylinder 82 between the lands 85' and 87'. The space between the lands 84 and 87 constitutes a recess 92 in piston 83 which communicates with the fluid return path 33. Similarly, the space between the lands 84' and 87' constitutes a recess 92' in piston 83 which communicates with the fluid return path 34. The housing 81 is formed to define an annular recess 93 in the interior surface of the cylinder 82 and which, in the neutral position of the parts shown, embraces the land 87 thereby providing fluid communication between the radial apertures 91 and the fluid return path 33. Similarly, the housing 81 is also formed to define a similar annular recess 93' which, in the neutral position of the parts shown, embraces the land 87' and provides communication between the sets of radial apertures 91' and the fluid return path 34. The housing 81 is also formed to define a branch conduit 94 having a junction 95 with the feedback passageway 73 and communicating with the hollow cylinder 82 in such position that, in the neutral position of the parts shown, the branch conduit 94 is in communication with the grooves 86. There is also provided a fluid restrictor 96 interposed in the feedback passageway 73 at a point between the junction 95 and the fluid return path 33. Similarly, the housing 81 is also formed to define a branch conduit 94' having a junction 95' with the feedback passageway 74 and which, in the neutral position of the parts shown, communicates with the groove 86'. Similarly, there is provided a restrictor 96' in the feedback passageway 74 between the junction 95' and the fluid return path 34. The housing 81 is also formed to define two fluid return passageways 15' and 15'' which connect the fluid connection 15 with the interior of the cylinder 82 at such positions that, in the neutral position of the parts shown, the fluid return passageways 15' and 15'' are in communication with the grooves 86 and 86' respectively.

OPERATION OF THE VALVE OF FIG. 4

Let us assume that the pilot inlet connection 53 of FIG. 1 is connected to a source of fluid under pressure and that the main inlet connection 14 of FIG. 4 is connected to a source of fluid at a constant rate of flow such as a fixed displacement pump. Then, in the absence of an input signal, the pressures in the control conduits 67 and 67' will be substantially equal and the piston 83 will be in the position shown in FIG. 4. Fluid from the inlet connection 14 will flow through the radial apertures 89 to the bore 88 where it will divide approximately equally left and right. The portion flowing to the left will flow through the apertures 91, the recesses 93 and 92 to the fluid return path 33. The pressure will open the poppet valve 38 and a portion of the fluid will flow through this valve to the chamber 35 and thence to the fluid return connection 15. Part of the fluid in the fluid return path 33 will flow through the restrictor 96, the branch conduit 94, the groove 86 and the fluid return connection 15' and thence through an internal passageway, shown dotted in the drawing, to the fluid return connection 15. The portion of the fluid flowing to the right in the axial bore 88 will follow a similar path through the apertures 91', the recesses 93' and 92' to the fluid return path 34 where it will divide, part of it flowing through the poppet valve 39 to the chamber 35 and the return 15 and the remainder flowing through the restrictor 96', the branch conduit 94', the groove 86' and the fluid return connection 15'' back to the fluid return connection 15. Since there is very little resistance to the flow of fluid from the inlet connection 14 to the return connection 15, the constant displacement pump will idle and consume very little power.

Let it be assumed that an input signal is applied to the torque motor 55 (FIG. 1) in such a sense as to displace the piston 63 to the left. This will increase the pressure in the control conduit 67 and decrease the pressure in the control conduit 67' with the result that the piston 83 (FIG. 4) will be urged to the right. However if this signal is very small, the springs 31 and 32 will effectively hold the piston 83 in the neutral position and no fluid will flow to the load. Assuming now that the input signal is increased, the pressure differential between the conduits 67 and 67' will rise sufficiently to move the piston 83 toward the right. The first thing that happens is that the right edge of the land 87 approaches the right edge of the recess 93 thereby restricting the flow of fluid from the recess 93 to the recess 92. At the same time, movement of the land 87' increases the size of the passageway between the recesses 93' and 92'. Eventually, the right edge of the land 87 reaches the right edge of the recess 93 and flow of fluid to the return path 33 ceases and the poppet valve 38 closes. At the same time the left edge of the groove 86 reaches the right edge of the branch conduit 94 and the right edge of the fluid return connection 15' thereby isolating the feedback passageway 73 from the fluid return connections 15' and 15. At about the same time that the right edge of the land 87 reaches the right edge of the recess 93, or just slightly thereafter, the left edge of the land 84 reaches the left edge of the load connection 16 and the left edge of the land 84' reaches the left edge of the load connection 17. As soon as these positions are passed, fluid can start to flow from the inlet connection 14 to the load connection 17 and back through the load connection 16 to the fluid return path 33. However, before fluid actually flows through the load connections 17 and 16, the pressure in the fluid return path 33 will start to rise and this rise in pressure will be transmitted through the restrictor 96 and the feedback passageway 73 to the first stage where, if the input signal is still small, the pressure will be sufficient to balance the force exerted by the torque motor 15 before the poppet valve 38 opens and the dead space will be extended beyond that provided by the centering springs 31 and 32. However, a further increase in the input signal will open the passageways to the load connections 17 and 16 sufficiently so that the pressure in the fluid return path 33 will rise high enough to open the poppet valve 38 and allow fluid to flow to the chamber 35 and to the return connection 15. The pressure drop across the poppet valve 38, which is in effect the pressure at the upstream side of this valve which exists in the fluid return path 33, is transmitted through the restrictor 96 and the feedback passageway 73 to the first stage and an equilibrium position is soon reached with the flow through the load connections 17 and 16 being that prescribed by the input signal. It is to be noted that during this operation the groove 86' maintains the fluid connection between the branch conduit 94' and the fluid return connection 15'' so that the pressure in the feedback passageway 74 is that of the return. Fluid from the inlet connection 14 continues to flow through the apertures 89, the bore 88, the apertures 91' and the recesses 93' and 92' and then through both the poppet valve 39 and the restrictor 96' to the return. Upon removal of the input signal, the parts will revert to the neutral position shown. An input signal of opposite sense would have a similar but opposite effect with fluid flowing from the inlet connection 14 to the load connection 16 and back through the load connection 17 to the fluid return path 34.

It is apparent that the operation of the valve of FIG. 4 is quite similar to that of FIG. 2 in that both the centering springs 31 and 32 and the poppet valves 38 and 99 play a part in establishing the dead zone. Additionally, both valves exhibit the same non-linear relationship between input signal and rate of flow and consequently both provide satisfactory operation over an unusually large dynamic range. The choice of one valve or the other for a particular application may well depend, in part, upon what sort of hydraulic power supplies are already available. If there is already available a source of fluid at a substantial pressure, it may be more economical to use the valve of FIG. 1. However, if a new power supply must be provided, it may be more economical to use the valve of FIG. 4 because it requires only a simple, constant displacement pump to supply fluid for the second, or main, stage. The first stage may be supplied from the same pump, preferably with additional filtration, or may use a separate source.

It is apparent that applicant has provided an improved flow control valve which is capable of providing a rate of flow to the load which follows an input signal very closely over an unusually large dynamic range. Although a number of specific embodiments have been described in considerable detail for illustrative purposes, many modifications will occur to those skilled in the art. It is therefore desired that the protection afforded by Letters Patent be limited only by the true scope of the appended claims.

I claim:

1. A valve system comprising first and second control conduits, a first stage responsive to an input signal for generating fluid control pressures in said conduits, a second stage comprising a cylinder and piston valve and including a fluid inlet connection, first and second fluid inlet connections, a fluid return connection, and first and second fluid return paths each interconnecting said cylinder and piston valve with said return connection, said cylinder and piston valve being responsive to said control pressures in said conduits for controlling the flow of fluid from said inlet connection to one of said load connections and from the other of said load connections through one of said fluid return paths to said fluid return connection, characterized in that said system includes first and second variable flow sensors interposed in said first and second return paths respectively, said sensors comprising first and second poppet valves each resiliently biased toward a closed position against the urging of the pressure in its associated return path, and first and second feedback passageways providing fluid communication between said first stage and said first and second return paths respectively at locations upstream of said sensors, said passageways transmitting fluid pressures from said return path so as to oppose the response of said first stage to said input signal.

2. A valve system in accordance with claim 1 in which said second stage includes a housing formed to define a chamber communicating with said fluid return connection, said housing also being formed to define first and second openings providing communication between said chamber and said first and second fluid return paths, respectively, first and second valve seats surrounding said first and second openings respectively, and in which said first and second poppet valves comprise first and second plate-like portions disposed in said chamber adjacent to said first and second valve seats respectively, and first and second springs urging said first and second plate-like portions into engagement with said first and second valve seats respectively.

3. A valve system in accordance with claim 1 in which said second stage cylinder and piston valve is a four way valve including a housing formed to define a hollow cylinder and including a piston within said cylinder and in which said piston includes first and second lands slightly overlapping said first and second load connections respectively when said piston is in a neutral position and in which said inlet connection communicates with said cylinder substantially in the center thereof between said first and second lands, and in which said fluid return paths are in communication with said cylinder on the sides of said lands remote from said inlet connection, and in which said piston includes third and fourth lands spaced outboard of said first and second lands respectively and which, with said cylinder, define first and second end spaces respectively, and in which said first and second control conduits are in communication with said first and second end spaces respectively.

4. A valve system in accordance with claim 3 which includes first and second springs disposed in said end spaces for urging said piston toward a neutral position.

5. A valve system in accordance with claim 3 in which said housing, said piston and said lands are of such form and are so relatively located as to block substantially all flow of fluid from said inlet connection when said piston is in said neutral position.

6. A valve system in accordance with claim 1 in which said first stage includes a pilot inlet connection, a pilot return connection, a torque motor responsive to said input signal and a pilot cylinder and piston valve actuated by said torque motor and cooperating with said pilot inlet connection and said pilot return connection for generating said fluid control pressures in said control conduits.

7. A valve system in accordance with claim 6 in which said pilot cylinder and piston valve includes a pilot housing formed to define a pilot hollow cylinder, first and second separate pistons disposed within said pilot cylinder, said torque motor including an actuating arm, means resiliently urging said first and second pistons into engagement with said actuating arm, each of said first and second pistons including first and second lands, each of said first lands being inboard of said second lands and cooperating with said first and second control conduits respectively to form first and second variable orifices interconnecting said first and second control conduits with said pilot return connection, first and second restrictors interconnecting said pilot inlet connection and said first and second control conduits respectively, said second lands of said first and second pistons cooperating with said pilot cylinder to define first and second end spaces respectively, said first and second feedback passageways being in fluid communication with said first and second end spaces respectively.

8. A valve system in accordance with claim 3 in which said housing, said piston and said lands are of such form and are so relatively located that with said piston in said neutral position there is a substantially unobstructed fluid path between said inlet connection and each of said first and second fluid return paths.

9. A valve system in accordance with claim 8 in which said piston is formed with an axially extending bore between the inboard faces of said third and fourth lands and is also formed with a first set of radial passageways hydraulically connecting said bore with the interior of said cylinder in the region of said inlet connection and also formed with second and third sets of radial passageways interconnecting said bore with the interior of said cylinder between said first and third lands and between said second and fourth lands respectively.

10. A valve system in accordance with claim 9 in which said piston includes a fifth land located between said first and third lands adjacent to said second set of radial passageways, said fifth and first lands defining a first recess in said piston communicating with said first fluid return path, said housing being formed with a first auxiliary recess on the interior surface thereof and located so that with said piston in said neutral position said first auxiliary recess provides communication between said second set of radial passageways and said first fluid return path, and in which said piston includes a sixth land located between said second and fourth lands adjacent to said third set of radial passageways, said sixth and second lands defining a second recess in said piston communicating with said second fluid return path, said housing being formed with a second auxiliary recess on the interior surface thereof and located so that with said piston in said neutral position said second auxiliary recess provides communication between said third set of radial passageways and said second fluid return path.

11. A valve system in accordance with claim 3 in which said third and fourth lands are formed with first and second annular grooves respectively around the peripheries thereof and in which said housing is formed to define first and second fluid return passageways connecting said return connection with the interior of said cylinder in such locations that with said piston in said neutral position said first and second annular grooves are in communication with said first and second fluid return passageways respectively.

12. A valve system in accordance with claim 11 which includes first and second branch conduits having first and second junctions with said first and second feedback passageways respectively and communicating with the interior of said cylinder in such locations that with said piston in said neutral position said first and second branch conduits are in communication with said first and second annular grooves respectively and which includes first and second fluid restrictors in said first and second feedback passageways respectively positioned between said first and second junctions and said first and second fluid return paths respectively.

* * * * *

UNITED STATES PATENT OFFICE
CERTIFICATE OF CORRECTION

PATENT NO. : 3,943,957

DATED : March 16, 1976

INVENTOR(S) : Paul F. Hayner

It is certified that error appears in the above-identified patent and that said Letters Patent are hereby corrected as shown below:

Column 9, line 34, cancel "inlet" and substitute --load--.

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*